US008550066B2

(12) United States Patent
Post

(10) Patent No.: US 8,550,066 B2
(45) **Date of Patent: *Oct. 8, 2013**

(54) HIGH EFFICIENCY FURNACE/AIR HANDLER BLOWER HOUSING WITH A SIDE WALL HAVING AN EXPONENTIALLY INCREASING EXPANSION ANGLE

(75) Inventor: Steven W. Post, Cassville, MO (US)

(73) Assignee: Regal Beloit America, Inc., Beloit, WI (US)

( * ) Notice: Subject to any disclaimer, the term of this patent is extended or adjusted under 35 U.S.C. 154(b) by 977 days.

This patent is subject to a terminal disclaimer.

(21) Appl. No.: 12/631,415

(22) Filed: Dec. 4, 2009

(65) Prior Publication Data

US 2010/0078007 A1 Apr. 1, 2010
US 2010/0263653 A2 Oct. 21, 2010

Related U.S. Application Data

(63) Continuation-in-part of application No. 11/935,726, filed on Nov. 6, 2007, now Pat. No. 8,025,049.

(51) Int. Cl.
*F04D 29/44* (2006.01)

(52) U.S. Cl.
USPC ..... 126/110 R; 126/99 R; 126/110 A; 415/204; 415/206

(58) Field of Classification Search
USPC ..... 126/99 R, 110 A, 110 R; 415/204, 206
IPC ..... F04D 29/44
See application file for complete search history.

(56) References Cited

U.S. PATENT DOCUMENTS

| | | | |
|---|---|---|---|
| 17,664 | A | 6/1857 | Braugh |
| 82,736 | A | 10/1868 | Mitchell |
| 662,395 | A | 11/1900 | Davidson |
| 675,375 | A | 6/1901 | Davidson |
| 839,273 | A | 12/1906 | Davidson |

(Continued)

FOREIGN PATENT DOCUMENTS

| | | | |
|---|---|---|---|
| DE | 19709193 | A1 | 10/1997 |
| JP | 61138900 | | 6/1986 |
| JP | 2004143995 | A | 5/2004 |

OTHER PUBLICATIONS

JP 61-138900 A Translation; FLS, Inc., Washington, D.C. Sep. 2010; pp. 1-10.

(Continued)

*Primary Examiner* — Steven B McAllister
*Assistant Examiner* — Daniel E Namay
(74) *Attorney, Agent, or Firm* — Thompson Coburn LLP

(57) ABSTRACT

An air distribution blower housing for an air handler such as a residential furnace is designed with a volute-shaped outer wall that has an exponentially increasing expansion angle in the direction of air flow through the blower housing for at least a portion of the volute-shaped outer wall length. This results in the blower housing having an enlarged air outlet opening that slows down and spreads out the air flow from the blower housing over a greater area of the furnace heat exchanger. The blower housing thereby enables less air pressure drop through the heat exchanger, which increases the efficiency of the blower motor operation. The design of the blower housing also efficiently turns the velocity head of the air flow through the housing to usable static air pressure at the housing air outlet.

19 Claims, 8 Drawing Sheets

(56) References Cited

U.S. PATENT DOCUMENTS

| | | | | |
|---|---|---|---|---|
| 866,887 | A | 9/1907 | Robinson | |
| RE12,796 | E | 5/1908 | Davidson | |
| RE12,797 | E | 5/1908 | Davidson | |
| RE12,798 | E | 5/1908 | Davidson | |
| 1,031,180 | A | 7/1912 | Hancock | |
| 1,111,250 | A | 9/1914 | Davidson | |
| 1,138,083 | A | 5/1915 | Carrier | |
| 1,282,065 | A | 10/1918 | Froelich | |
| 1,462,557 | A | 7/1923 | Kuenzel, Jr. | |
| 1,637,652 | A | 8/1927 | Ness | |
| 1,875,881 | A | 9/1932 | Morse | |
| 1,877,905 | A | 9/1932 | le Grand | |
| 1,892,930 | A | 1/1933 | Burman | |
| 1,895,488 | A | 1/1933 | Reisinger | |
| 1,935,120 | A | 11/1933 | Hagen | |
| 2,083,996 | A | 6/1937 | Jonn | |
| 2,155,631 | A | 4/1939 | Anderson | |
| 2,165,069 | A | 7/1939 | Reynolds | |
| 2,225,398 | A | 12/1940 | Hamblin | |
| 2,301,857 | A | 11/1942 | Criqui | |
| 2,322,357 | A | 6/1943 | Hagen | |
| 2,441,411 | A | 5/1948 | Hagen | |
| 2,564,775 | A | 8/1951 | Besser | |
| 2,649,242 | A * | 8/1953 | Payne | 415/52.1 |
| 3,098,603 | A | 7/1963 | Baker | |
| 3,154,242 | A | 10/1964 | Harris | |
| 3,191,851 | A | 6/1965 | Wood | |
| 3,227,150 | A | 1/1966 | Reznick et al. | |
| 3,275,223 | A | 9/1966 | Fowell | |
| 3,332,612 | A | 7/1967 | Gross | |
| 3,382,862 | A | 5/1968 | Martz | |
| 3,407,995 | A | 10/1968 | Kinsworthy | |
| 3,481,321 | A | 12/1969 | Reichelderfer | |
| 3,491,550 | A | 1/1970 | Cavis | |
| 3,561,906 | A | 2/1971 | Fermer | |
| 3,619,088 | A | 11/1971 | Bullock | |
| 3,638,636 | A | 2/1972 | Marshall et al. | |
| 3,746,464 | A | 7/1973 | Goettl | |
| 3,820,526 | A | 6/1974 | Van Vliet | |
| 3,846,040 | A | 11/1974 | Dennis | |
| 3,950,835 | A | 4/1976 | Bennink et al. | |
| 4,035,610 | A | 7/1977 | Roth | |
| 4,309,977 | A | 1/1982 | Kitchen et al. | |
| 4,419,049 | A | 12/1983 | Gerboth et al. | |
| 4,424,006 | A | 1/1984 | Armbruster | |
| 4,828,456 | A | 5/1989 | Bodzian et al. | |
| 4,917,572 | A | 4/1990 | Van Houten | |
| 5,141,397 | A | 8/1992 | Sullivan | |
| 5,178,124 | A * | 1/1993 | Lu et al. | 126/110 R |
| 5,257,904 | A | 11/1993 | Sullivan | |
| 5,301,654 | A | 4/1994 | Weber, III et al. | |
| 5,309,890 | A | 5/1994 | Rieke et al. | |
| 5,368,010 | A | 11/1994 | Weber, III et al. | |
| 5,375,586 | A | 12/1994 | Schumacher et al. | |
| 5,377,662 | A | 1/1995 | Mills et al. | |
| 5,379,750 | A | 1/1995 | Larsen et al. | |
| 5,379,751 | A | 1/1995 | Larsen et al. | |
| 5,380,193 | A | 1/1995 | Williams et al. | |
| 5,406,933 | A | 4/1995 | Lu | |
| 5,427,503 | A | 6/1995 | Haraga et al. | |
| 5,448,986 | A | 9/1995 | Christopher et al. | |
| 5,570,996 | A | 11/1996 | Smiley, III | |
| 5,601,400 | A | 2/1997 | Kondo et al. | |
| 5,813,834 | A | 9/1998 | Hopfensperger et al. | |
| 6,273,679 | B1 | 8/2001 | Na | |
| 6,296,478 | B1 | 10/2001 | Gatley, Jr. | |
| 6,314,894 | B1 | 11/2001 | Gatley, Jr. | |
| 6,318,358 | B1 | 11/2001 | Gatley, Jr. | |
| 6,352,431 | B1 | 3/2002 | Gatley, Jr. | |
| 6,439,839 | B1 | 8/2002 | Song et al. | |
| 6,468,034 | B1 | 10/2002 | Garrison et al. | |
| 6,494,152 | B2 | 12/2002 | Gatley, Jr. | |
| 6,511,290 | B1 | 1/2003 | Gatley, Jr. | |
| 6,578,629 | B1 | 6/2003 | Trent | |
| 6,585,484 | B2 | 7/2003 | Rosenthal et al. | |
| 6,595,146 | B2 | 7/2003 | Gatley, Jr. | |
| 6,767,184 | B2 | 7/2004 | Kim et al. | |
| 6,821,088 | B2 | 11/2004 | Sakai et al. | |
| 6,895,874 | B2 | 5/2005 | Gatley, Jr. | |
| 6,902,373 | B1 | 6/2005 | Glanton | |
| 6,908,281 | B2 | 6/2005 | Lyons et al. | |
| 6,929,448 | B1 | 8/2005 | Lyons et al. | |
| 6,951,241 | B1 | 10/2005 | Gatley | |
| 6,953,319 | B2 | 10/2005 | Sohn et al. | |
| 7,014,422 | B2 * | 3/2006 | Hancock | 415/204 |
| 7,182,574 | B2 | 2/2007 | Lyons | |
| 7,210,903 | B2 | 5/2007 | Lyons | |
| 7,334,986 | B2 | 2/2008 | Sohn et al. | |
| 7,338,256 | B2 | 3/2008 | Kuo et al. | |
| 7,431,642 | B2 | 10/2008 | Herbst | |
| 7,500,825 | B2 | 3/2009 | Hanai | |
| 7,549,842 | B2 | 6/2009 | Hanson et al. | |
| 2002/0014233 | A1 | 2/2002 | Gatley et al. | |
| 2002/0064457 | A1 * | 5/2002 | Pauly | 415/204 |
| 2003/0012649 | A1 | 1/2003 | Sakai et al. | |
| 2004/0062646 | A1 | 4/2004 | Nomura | |
| 2006/0013684 | A9 * | 1/2006 | Tamagawa et al. | 415/206 |
| 2006/0024160 | A1 * | 2/2006 | Horng et al. | 415/206 |
| 2006/0034686 | A1 | 2/2006 | Smiley et al. | |
| 2006/0051205 | A1 | 3/2006 | Platz | |
| 2006/0083610 | A1 * | 4/2006 | Hisaka et al. | 415/206 |
| 2006/0165521 | A1 * | 7/2006 | Kim | 415/204 |
| 2007/0092373 | A1 | 4/2007 | Chen et al. | |
| 2007/0212218 | A1 * | 9/2007 | Seki et al. | 415/204 |
| 2007/0231130 | A1 * | 10/2007 | Hanazuka et al. | 415/206 |
| 2007/0274833 | A1 | 11/2007 | Sakai et al. | |
| 2008/0187439 | A1 * | 8/2008 | Iyer | 415/204 |
| 2008/0193285 | A1 * | 8/2008 | Spaggiari | 415/206 |
| 2008/0267774 | A1 * | 10/2008 | Lian | 415/204 |
| 2008/0310957 | A1 | 12/2008 | Lyons | |
| 2009/0114206 | A1 | 5/2009 | Post | |
| 2009/0252605 | A1 | 10/2009 | Lyons | |
| 2011/0217188 | A1 | 9/2011 | Lyons | |

OTHER PUBLICATIONS

U.S. Appl. No. 60/943,955, filed Jun. 14, 2007 (Lyons).

* cited by examiner

HIGH EFFICIENCY FURNACE/AIR HANDLER BLOWER HOUSING WITH A SIDE WALL HAVING AN EXPONENTIALLY INCREASING EXPANSION ANGLE

RELATED APPLICATION DISCLOSURE

This patent application is a continuation-in-part of patent application Ser. No. 11/935,726, which was filed on Nov. 6, 2007, and is currently pending.

BACKGROUND OF THE INVENTION

1. Field of the Invention

The present invention pertains to a high efficiency furnace and a low profile furnace that each comprise a compact enclosure for residential use and an air distribution blower housing that is designed with an outer wall having an exponentially increasing expansion angle and an enlarged air outlet opening. The enlarged outlet opening slows down and spreads out the air flow from the blower housing over a greater area of the secondary heat exchanger and the primary heat exchanger of the high efficiency furnace, and over a greater area of the heat exchanger of a low profile furnace. Thus, the blower housing enables less air pressure drop through the heat exchangers, which increases the efficiency of the blower operation. The design of the blower housing also efficiently turns the velocity head of the air flow to usable static pressure at the housing air outlet. The enlarged air outlet opening of the blower housing is achieved without increasing the exterior dimensions of the blower housing whereby the blower housing is used in a compact enclosure for residential use. This is accomplished by utilizing a unique design volute outer wall of the blower housing that has a unique exponentially increasing expansion angle in the direction of air flow through the blower housing and compact relative positioning of the blower housing and heat exchangers in the furnace enclosure.

2. Description of Related Art

High efficiency residential natural gas powered furnaces are becoming more and more common. A furnace of this type is defined in the industry as a 90+ AFUE (Annul Fuel Utilization Efficiency) furnace. A 90+ furnace converts more than 90% of the fuel supplied to the furnace to heat, with the remainder being lost through the chimney or exhaust flue. These particular types of furnaces employ a primary heat exchanger found in most any type of furnace, plus an additional secondary heat exchanger. The secondary heat exchanger increases the capacity of the furnace to convert the heat of the gas combustion to the distribution air flow from the furnace, and thereby defines the furnace as a high efficiency furnace.

The typical construction of a high efficiency furnace 10 is shown in FIG. 1. The furnace 10 has an external housing enclosure 12 with an interior volume 14. Several portions of the side walls of the furnace enclosure 12 shown in FIG. 1 have been removed to illustrate the interior components of the furnace. The dimensions of the furnace enclosure 12 are determined to contain all of the component parts of the furnace in the enclosure 12, without the enclosure occupying a significant area in the residence in which the furnace is installed. In contrast, commercial furnaces are typically mounted on the roof of a building or at some other location outside the building where there are no size restraints. Because commercial furnaces with their large capacity are located outside the structures they serve, there is no need to position the component parts of the furnace relative to each other to minimize the size of the furnace enclosure as there is in residential furnaces.

An air inlet opening is typically provided in a side wall or in the bottom of the furnace enclosure. The air inlet opening can be covered by an air filter that allows ambient air in the environment surrounding the enclosure 12 to easily pass through the opening and enter the enclosure interior 14. Alternatively and more frequently, the air inlet opening of the furnace enclosure communicates with a cold air return duct system of the residence. The cold air return duct system channels ambient air from throughout the residence to the furnace enclosure.

The furnace enclosure also has an air distribution outlet opening 18. The outlet opening communicates with an air distribution conduit or duct system of the residence in which the furnace is installed. In FIG. 1, the air distribution outlet opening is located at the top of the enclosure 12. The air heated by the high efficiency furnace 10 is discharged to the air distribution conduit system (not shown) through the distribution air outlet opening 18.

In the typical construction of a high efficiency furnace represented in FIG. 1, a primary heat exchanger 22 is located at the top of the enclosure 12 adjacent the distribution air outlet opening 18. A secondary heat exchanger 24 that qualifies the furnace as a high efficiency furnace is located directly below the primary heat exchanger 22.

An air distribution blower 26 that draws ambient air into the furnace enclosure 12 is positioned just below the secondary heat exchanger 24. A motor (not shown) of the blower rotates a fan wheel 28 in the interior of the blower in a clockwise direction as viewed in FIG. 1. This rotation of the fan wheel 28 draws the ambient air into the blower 26 as represented by the arrow labeled (AIR FLOW) in FIG. 1, and pushes the ambient air out of the blower through the secondary heat exchanger 24, then through the primary heat exchanger 22, and then out of the enclosure through the air distribution outlet opening 18.

A typical blower 26 includes a blower housing that contains the fan wheel 28. The typical blower housing includes an exterior or outer wall 32 having a scroll or volute configuration. The outer wall 32 spirals around the fan wheel 28 in the direction of fan wheel rotation. A pair of side walls 34, only one of which is shown in FIG. 1, cover over opposite sides of the volute outer wall 32 and enclose the interior of the blower 26.

As shown in FIG. 1, the typical volute outer wall 32 of the blower housing has a constant expansion angle as it extends in the fan wheel rotation direction around the fan wheel. What is meant by expansion angle is the angle at which the outer wall expands in the direction of fan wheel rotation from any point on the exterior of the outer wall 32. In the typical construction of a blower housing outer wall 32 such as that shown in FIG. 1, this expansion angle is constant for all points along the volute outer wall 32 in the rotation direction, resulting in a gradually increasing distance between the outer circumference of the fan wheel 28 and the outer wall 32 as the outer wall extends in the rotation direction around the fan wheel.

The air distribution blower 26 of the typical high efficiency furnace represented in FIG. 1 has been found to be disadvantaged in that the flow of air directed from the blower is primarily concentrated on only small portions of the secondary heat exchanger 24 and the primary heat exchanger 22. The air flow directed from the blower through the portions of the heat exchangers is represented by the arrows 34 shown in FIG. 1. As seen in FIG. 1, the scroll configuration of the volute outer wall 32 and the close positioning of the fan wheel 28 to the interior surface of the outer wall 32 primarily concentrates the flow of air through the reduced areas of the secondary heat exchanger 24 and the primary heat exchanger 22 shown to the left in FIG. 1. This reduces the efficiency of heat transfer from the heat exchangers to the air flow. The concentration of the air flow to reduced areas of the secondary 24 and the primary 22 heat exchanger also results in a significant pressure drop. This additional pressure drop requires additional blower horsepower, i.e. a larger blower motor. The requirement for a larger blower motor decreases the electrical efficiency of the furnace. Also, the heat generated by operating a larger motor would especially detract from the cooling system efficiency when an air conditioning heat exchanger is added at the air outlet opening 18 in the enclosure 12. If the problem of the concentration of air flow through the reduced areas of the heat exchangers is attempted to be overcome by simply enlarging the size of the exhaust outlet of the conventional blower housing, the resulting scroll shape of the blower housing would not be able to adequately convert the velocity head of the air flowthrough the housing into static pressure of the resulting blower system and the overall blower system would not be successful in saving energy.

SUMMARY OF THE INVENTION

The present invention overcomes the efficiency problems associated with the constructions of prior art 90+ furnace blowers by providing a blower with a unique housing design that spreads out the distribution air flow over the secondary heat exchanger to a larger extent than the existing blowers of the prior art. This enables the blower to operate with less of a pressure drop through the heat exchangers than that of prior art blowers. The scroll design of the blower housing also efficiently turns the velocity head of the air flow through the housing to usable static air pressure. In addition, it has been found through testing that the blower housing design of the invention applied to a low profile 80+ furnace blower has a similar or superior static efficiency to that of a regular profile blower. In a similar manner to the 90+ furnace, in an 80+ furnace where the primary heat exchanger is located close to the blower housing air outlet opening, the enlarged air outlet opening of the blower housing of the invention directs air over a larger area of the primary heat exchanger than blower housings of the prior art, and thereby creates energy savings. This enables the design of the blower housing to be employed in low profile 80+ furnaces to provide an efficiency gain, even though there is no secondary heat exchanger in the low profile furnace. The improved efficiency of the blower housing enables a reduction in the exterior dimensions of the furnace enclosure in which the blower housing is used.

In the typical construction of an air distribution blower, the pressure loss is proportional to the air flow velocity squared through a given restriction of the blower housing. Just a 15 percent increase in a two dimensional rectangular plane that represents the effective flow area across the secondary heat exchanger of the furnace can potentially create a ($1.15\times1.15=1.3225$), ($1/1.3225=0.756$) 25% increase in efficiency due to air pressure loss at the secondary heat exchanger.

With this in mind, the high efficiency furnace of the present invention employs a blower housing with an enlarged air outlet opening, while the exterior dimensions of the blower housing remain substantially the same as those of the prior art blower housing used in a high efficiency furnace.

The blower housing of the present invention employs a fan wheel with forward curved impeller blades for low noise and for reducing the size of the fan wheel. Fan wheels with forward curved impeller blades are known to create large amounts of pressure and air flow for a relatively small size of fan wheel.

To obtain a large air outlet opening in the blower housing without increasing the exterior dimensions of the blower housing, the present invention utilizes an exponentially increasing expansion angle along the length of the blower housing volute-shaped outer wall. Alternatively, the blower housing of the invention utilizes an exponentially increasing expansion angle along a substantial portion of, or substantial portions of the outer wall. Where the expansion angle of the volute outer wall of prior art blower housings increases at a constant rate, the expansion angle of the volute outer wall of the blower housing of the present invention increases exponentially as the outer wall extends around the fan wheel in the rotation direction of the fan wheel. The exponentially increasing expansion angle of the volute outer wall provides a very large air outlet opening while still having a volute shape around the entire length of the blower housing outer wall following the outer wall cutoff.

In a preferred embodiment, the expansion angle of the last quarter of the volute-shaped outer wall length, from 270° to 360° of the volute-shaped length increase at an exponential rate in a range of 1.5 to 2.1. This exponent range of 1.5 to 2.1 has proved to be critical to the operation of the high efficiency blower housing of the invention. The expansion angle increasing at a smaller exponential rate than the preferred range does not create the desired coriollis component to pull the air flow through the impeller or the required scroll housing volume. The expansion angle increasing at a larger exponential rate than the preferred range will concentrate excessive air flow through a small portion of the impeller and the overall expanded blower housing will not smoothly convert the air flow velocity head in the blower housing to static pressure. All of these attributes are important for a high efficiency blower housing's operation.

BRIEF DESCRIPTION OF THE DRAWINGS

Further features of the invention are set forth in the following detailed description of the invention and in the drawing figures.

DETAILED DESCRIPTION OF THE PREFERRED EMBODIMENT

Figure 1:
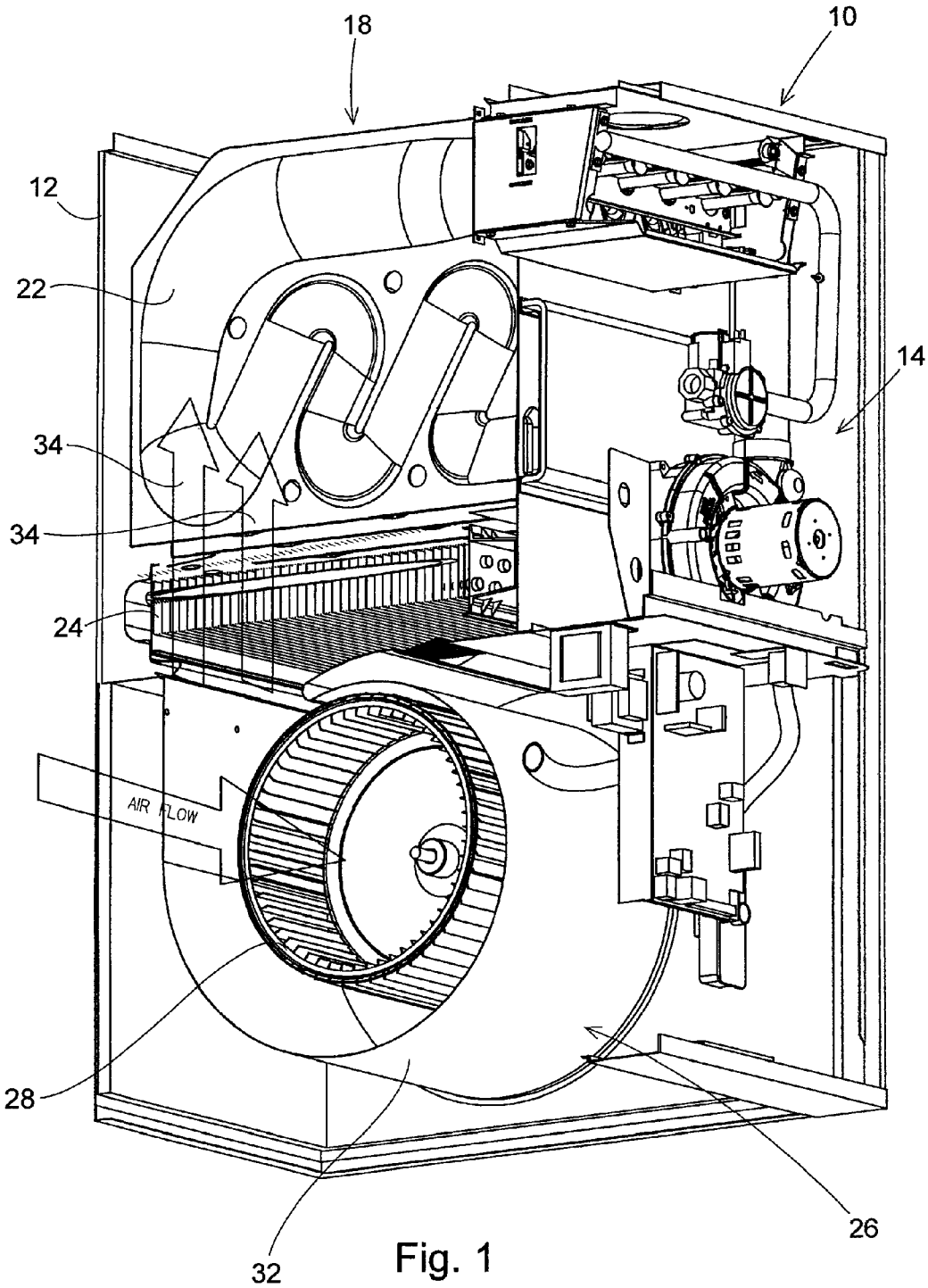
Fig. 1 PRIOR ART
FIG. 1 is a partial view of the construction of a prior art high efficiency furnace.
Figure 2:
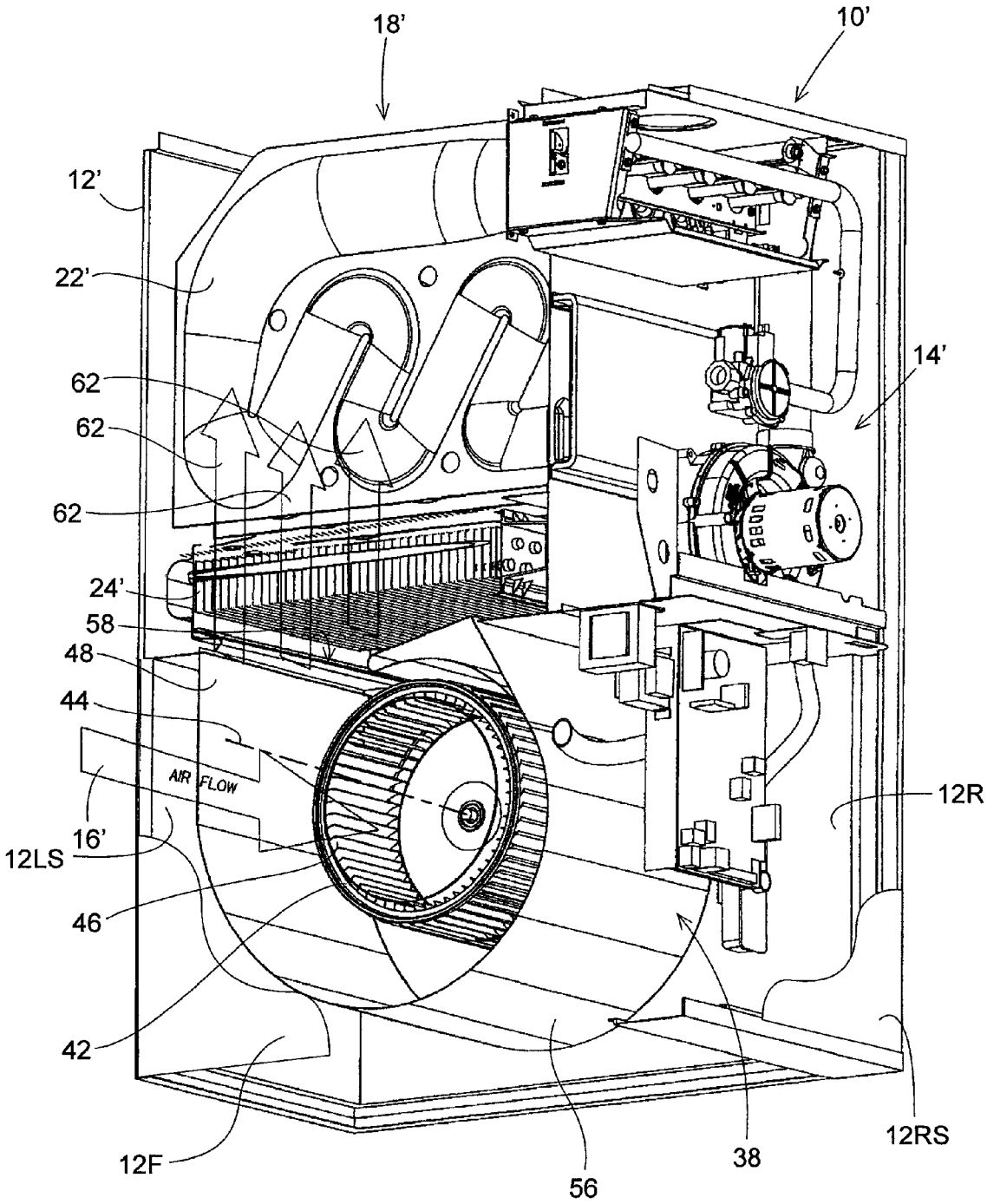
FIG. 2 is a partial view of the high efficiency furnace of FIG. 1 employing the unique blower housing of the present invention.

FIG. 2 is a perspective, cut away view of the high efficiency furnace of the invention that employs the blower housing of the invention having an enlarged air outlet opening and an exponentially increasing expansion angle. The furnace of the invention is primarily constructed in the same manner as known high efficiency furnaces. The difference in the furnace of the invention is in the unique design of the blower housing of the furnace. This unique design of the blower housing provides a superior distribution of air flow through the secondary and primary heat exchangers of the furnace, and thereby reduces the horsepower required by the distribution blower motor enabling an increase in the efficiency of the high efficiency furnace. Because much of the construction of the furnace shown in FIG. 2 is the same as that of FIG. 1, the same component parts of the furnace of FIG. 2 will be described only generally and are identified by the same reference numbers used in identifying the component parts in FIG. 1, but with the reference numbers being followed by a prime (').

The high efficiency furnace 10' of the present invention also includes an external housing enclosure 12' that contains the interior volume 14' of the furnace. Only a rear wall 12R and a left side wall 12LS of the furnace enclosure 12' are entirely shown in FIG. 2. The front wall 12F and right side 12RS wall are shown with portions removed to provide a view of the interior components of the furnace. It should be understood that the front and rear walls have the same width and height dimensions and the left side and right side walls have the same width and height dimensions whereby the enclosure has the exterior configuration of a rectangular cube. The front wall 12F of the furnace enclosure or the bottom of the furnace enclosure is provided with an air inlet opening that allows ambient air of the residence in which the furnace is used to enter into the enclosure interior 14'. The air inlet opening is often communicated with a cold air return duct system of the residence. Air that is heated by the furnace 10' is discharged to an air distribution conduit system of the residence (not shown) through a distribution air outlet opening 18'. The distribution air outlet opening 18' is positioned at the top of the enclosure shown in FIG. 2.

The primary heat exchanger 22' is positioned at the top of the enclosure interior volume 14' adjacent the distribution air outlet opening 18'. The secondary heat exchanger 24' is positioned just below the primary heat exchanger 22'. The use of both a primary heat exchanger and a secondary heat exchanger qualifies the furnace of the invention as a high efficiency furnace, or a 90+ AFUE furnace.

The blower 38 of the invention is positioned in the enclosure interior 14' at the same position as the prior art blower 26, i.e., just below the secondary heat exchanger 24'. Comparing the prior art of FIG. 1 with the furnace of the invention shown in FIG. 2, it can be seen that the blower 38 of the invention employs a fan wheel 42 having a smaller circumferential dimension C and a smaller diameter dimension D from the fan wheel 28 of the prior art. The fan wheel has an axis of rotation 44 that defines mutually perpendicular axial and radial directions relative to the blower 38. As shown in FIG. 2, the fan wheel rotates in a clockwise rotation direction when the fan is operating. Rotation of the fan wheel 42 draws ambient air into the blower 38 as represented by the arrow labeled (AIR FLOW) in FIG. 2. In the preferred embodiment, the fan wheel 42 is comprised of a plurality of forward curved fan blades 46. The forward curved fan blades 46 of the fan wheel 42 reduce the noise of operation of the fan wheel 42. Furthermore, the air flow moving through the fan wheel 42 is concentrated in the last half of the scroll shaped outer wall of the blower housing, and especially in the last 90 degrees of the scroll shaped outer wall where the expansion angle of the outer wall exceeds 10 degrees. This creates a higher velocity of air flow through the forward curved fan blades 46, which increases the static pressure gained on the fan wheel 42 due to the coriollis effect. The higher air flow velocity also increases the velocity head of the air flow off of the forward curved blades 46. This effect reduces the size of the fan wheel required for an equal powered blower, and increases the efficiency of the blower due to the greater pressure being generated on the fan wheel blades.

The apparent way to increase the exhaust area size of the blower housing air outlet opening is to increase the expansion angle of the blower housing outer wall. However, the prior art practice has been to design blower housings with a constant expansion angle. Some prior art blower housings have used increasing expansion angles, but the manner in which the blower housing's expansion angles were increased did not achieve the desired effect due to either the rate of increasing the expansion angle being inadequate, or the rate of increasing the expansion angle being too large and thus missing the desired effect. Additionally, increasing the expansion angle of the blower housing outer wall creates an extremely large blower housing that does not fit adequately in the typical furnace enclosure. The resultant additional size of the furnace enclosure needed to house a blower housing having an increased expansion angle creates a negative aspect for the consumer, i.e., the furnace enclosure requires more space in the consumer residence. Additionally, the manufacturer of the furnace must add cost to make the larger enclosure to accommodate the blower housing. Thus, merely increasing the exhaust area of the air outlet opening of a blower housing by increasing the expansion angle of the blower housing outer wall is not a viable option.

Figure 3:
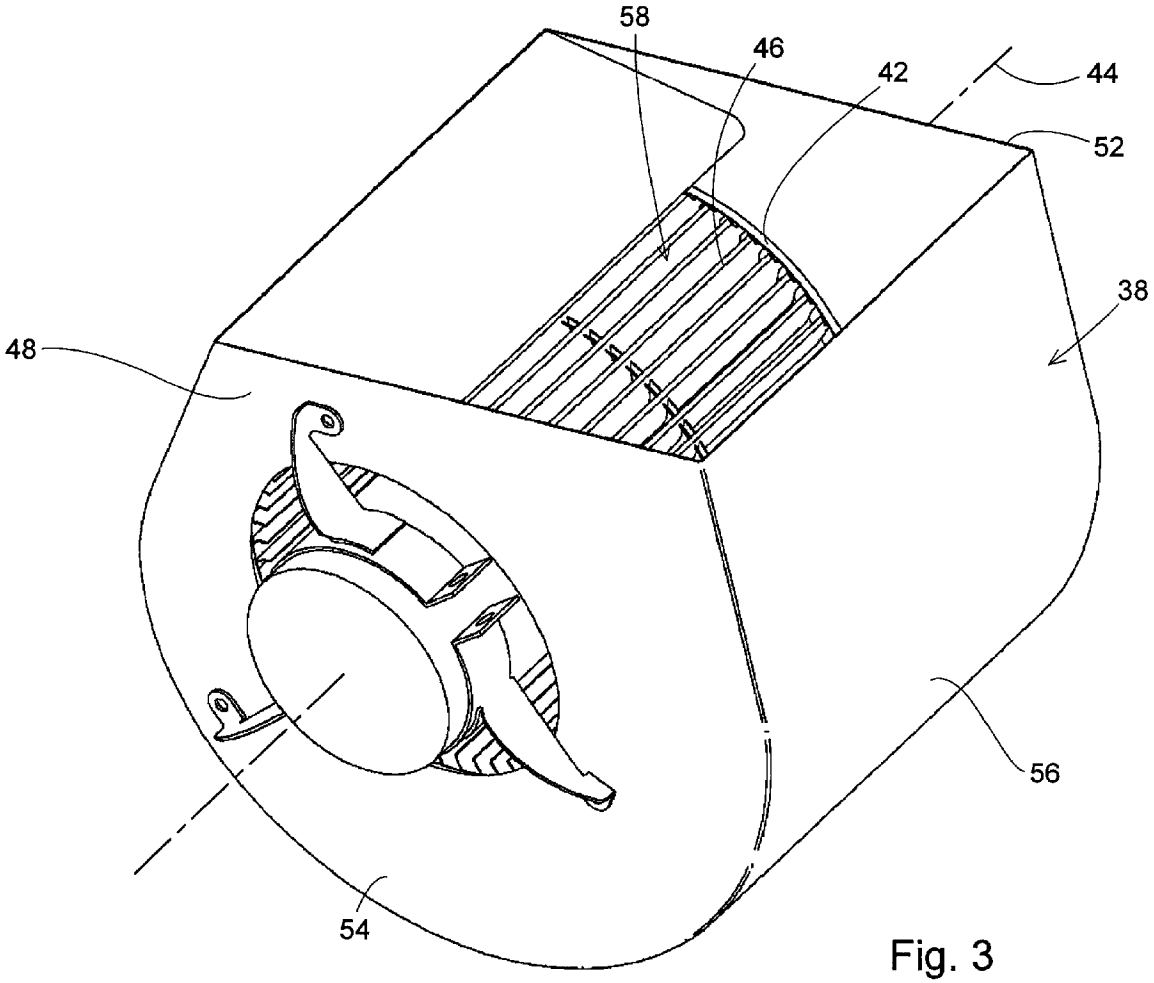
FIG. 3 is a perspective view of the opposite side of the blower housing in FIG. 2, removed from the furnace enclosure.

FIG. 2 shows one side of the blower housing 48 of the invention. FIG. 3 shows the opposite side of the blower housing 48, with the blower housing having been removed from the high efficiency furnace enclosure 12'. The opposite first 52 and second 54 side walls of the blower housing are constructed in the typical manner as prior art blower housings and are basically flat, parallel side walls positioned at axially opposite ends of the fan wheel 42. An air inlet opening is provided in the first side wall 52, and an opening that accommodates the motor that rotates the fan wheel 42 is provided in the second side wall 54. The side walls of the blower housing of the invention are basically the same as those of the prior art.

To obtain a large exhaust area of the blower housing air outlet opening, the blower housing 48 of the present invention utilizes an exponentially increasing expansion angle in the design of the blower housing volute outer wall 56. FIG. 2 shows the blower housing 48 positioned in the high efficiency furnace 10', with the first side wall being removed to show the position of the fan wheel 42 in the interior of the blower housing 48 and the relative positioning of the blower housing 48 in the furnace 10'. As shown in FIG. 2, the novel configuration of the blower housing outer wall 56 creates an enlarged air outlet opening 58 of the blower housing. This enlarged air outlet opening 58 directs distribution air over a larger area of the secondary heat exchanger 24' and the primary heat exchanger 22' than blower housings of the prior art such as that shown in FIG. 1. This greater amount of distribution air is represented by the arrows 62 in FIG. 2. The enlarged air outlet opening 58 spreads the flow of air out over the furnace heat exchanger and thereby reduces the pressure loss across the furnace. This lowers the required pressure that the blower must generate, and enables the use of a more efficient motor to operate the blower.

Furthermore, the blower housing of the invention does a superior job of pulling the air flow through the forward curved impeller blades, along with converting the air flow velocity through the housing scroll to usable static pressure. Although the blower housing of the invention has special benefits with respect to its use in furnaces by reducing the pressure through those furnaces, the blower housing of the invention also has superior efficiency as a blower housing used in an air handler where high efficiency is desired.

As stated earlier, the larger air distribution outlet opening 58 is achieved by employing an exponentially increasing expansion angle in the design of the volute-shaped outer wall 56 of the blower housing, as opposed to the constant increasing expansion angle employed in the design of prior art blower housings. The enlarged air outlet opening 58 is also achieved with the overall blower housing width dimension, the length dimension and the depth dimension of the blower housing 48 being the same as that of prior art blower housings. The improved efficiency of the blower housing enables a reduction in the exterior dimensions of the furnace enclosure in which the blower housing is used.

With the exponentially increasing expansion angle of the outer wall 56 of the blower housing, as the blower housing volute outer wall 56 extends around the blower housing in the rotation direction of the fan wheel, the scroll volume aggressively becomes larger in the interior of the housing. This is especially true as the outer wall 56 approaches the air outlet opening 58. This increase in the interior volume enables exhaust velocities of air flow to be reduced, and creates a blower housing where a greater portion of the air flow velocity head is converted to static pressure. This increases efficiency because the air flow velocity head energy would have been lost outside of the scroll interior. This further increases the overall efficiency of the blower housing.

Figure 4:
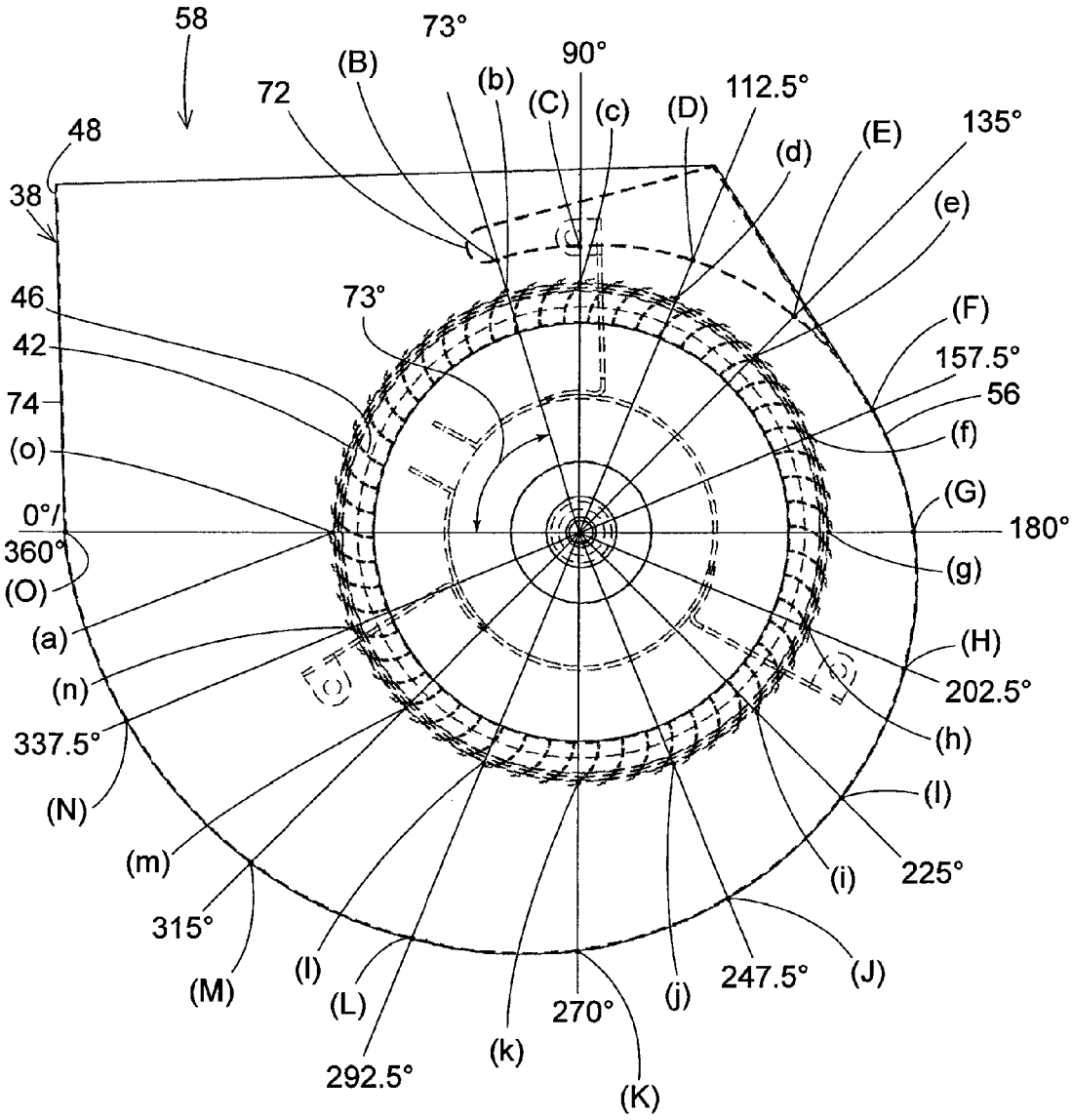
FIG. 4 is a side elevation view of the blower housing of FIG. 3, and is a schematic representation of the dimensional relationships between the circumference of the fan wheel and the volute-shaped outer wall of the blower housing of the invention.

FIG. 4 is a schematic representation of a side view of the blower housing volute outer wall 56 and the fan wheel 42 in the blower housing. The description of the blower housing 48 and the fan wheel 42 to follow is only one exemplary embodiment of the blower 38 of the invention. In other environments the construction of the blower housing and fan wheel may vary. However, as will be explained, the construction and the design of the blower housing outer wall 56 is based on an exponentially increasing expansion angle, where many prior art blower housings have been designed with a constant increasing expansion angle. The exponentially increasing expansion angle can be utilized along the entire volute-shaped length of the outer wall, or along only a portion of the volute-shaped length of the outer wall, or along separate portions of the volute-shaped length of the outer wall. Furthermore, the construction of the volute outer wall radially opposite any point on the circumference of the fan wheel is proportional to the circumferential dimension of the fan wheel at that point, raised to an exponential value.

The blower housing outer wall 56 has a volute-shaped portion that defines a majority of the length of the outer wall. The volute-shaped portion of the outer wall 56 could also be described as having a scroll configuration or a spiral configuration. These general configurations are common to blower housings of the prior art. However, the novel configuration of the blower housing outer wall 56 of the invention is defined as having an exponentially increasing expansion angle as the volute-shaped wall 56 extends in the rotation direction around the fan wheel axis of rotation 44. As viewed in FIG. 4, the outer wall includes a cut-off portion 72. The outer wall also includes a straight portion 74 at the enlarged air outlet opening 58. The straight portion 74 of the outer wall has no expansion angle and extends in a straight line. The volute-shaped outer wall 56 is the length of the outer wall that extends from the cutoff 72 to the straight portion 74.

FIG. 4 illustrates the dimensional relationship between a portion of the circumference of the fan wheel 42 and the volute shape length of the outer wall 56 of the invention that is positioned radially opposite the portion of the fan wheel. The fan wheel 42 shown in FIG. 4 has a diameter dimension and circumference dimension. In the explanation of the construction of the blower housing outer wall 56 to follow, the dimensions of the outer wall are based on circumferential dimensions of the fan wheel circumference. These circumferential dimensions of the fan wheel begin at point (b) on the fan wheel shown in FIG. 4. The dimensions are measured around in a clockwise rotation direction as shown in FIG. 4 to an ending point on the fan wheel that coincides with the point (o). A line drawn from the fan wheel axis of rotation 44 through the fan wheel beginning point (a) marks a zero degree reference point on the circumference of the fan wheel.

Beginning from the fan wheel reference point (a) at the zero degree circumference of the fan wheel, and extending around the fan wheel circumference in the clockwise direction of rotation of the fan wheel shown in FIG. 4, a second point (b) is positioned on the fan wheel 73 degrees from the first point (a). Point (b) is the beginning of the portion of the fan wheel circumferential dimensions that are used in determining the dimensions of the outer wall 56. A third point (c) is positioned on the fan wheel 90 degrees from the first point (a). Point (c) is also 17 degrees from point (b) which is 0.047 of the fan wheel circumference. A fourth point (d) is positioned on the fan wheel 112.5 degrees from the first point (a). Point (d) is also 39.5 degrees from point (b) which is 0.110 of the fan wheel circumference. A fifth point (e) is positioned on the fan wheel 135 degrees from the first point (a). Point (e) is also 62 degrees from point (b) which is 0.172 of the fan wheel circumference. A sixth point (f) is positioned on the fan wheel 157.5 degrees from the first point (a). Point (f) is also 84.5 degrees from point (b) which is 0.235 of the fan wheel circumference. A seventh point (g) is positioned on the fan wheel 180 degrees from the first point (a). Point (g) is also 107 degrees from point (b) which is 0.297 of the fan wheel circumference. An eighth point (h) is positioned on the fan wheel 202.5 degrees from the first point (a). Point (h) is also 129.5 degrees from point (b) which is 0.360 of the fan wheel circumference. A ninth point (i) is positioned on the fan wheel 225 degrees from the first point (a). Point (i) is also 152 degrees from point (b) which is 0.422 of the fan wheel circumference. A tenth point (j) is positioned on the fan wheel 247.5 degrees from the first point (a). Point (j) is also 174.5 degrees from point (b) which is 0.485 of the fan wheel circumference. An eleventh point (k) is positioned on the fan wheel 270 degrees from the first point (a). Point (k) is also 197 degrees from point (b) which is 0.547 of the fan wheel circumference. A twelfth point (l) is positioned on the fan wheel 292.5 degrees from the first point (a). Point (l) is also 219.5 degrees from point (b) which is 0.610 of the fan wheel circumference. A thirteenth point (m) is positioned on the fan wheel 315 from the first point (a). Point (m) is also 242 degrees from point (b) which is 0.672 of the fan wheel circumference. A fourteenth point (n) is positioned on the fan wheel 337.5 degrees from the first point (a). Point (n) is also 264.5 degrees from point (b) which is 0.735 of the fan wheel circumference. A fifteenth point (o) is positioned on the fan wheel 360 degrees from the first point (a) and coincides with the first point. Point (o) is also 287 degrees from point (b) which is 0.797 of the fan wheel circumference. These multiple points on the fan wheel are radially aligned with points on the blower housing outer wall 56. The circumferential distances of the fan wheel points (b-o) from the point (b) on the fan wheel are employed in calculating the distance of the blower housing outer wall 56 from the circumference of the fan wheel 42 at each of the radially aligned points on the blower housing outer wall. In this way the exponentially increasing expansion angle of the blower housing of the invention is determined.

The beginning of the volute or scroll shaped configuration of the outer wall 56 begins just past the cut-off portion 82 in the direction of rotation of the fan wheel 42. The beginning end of the volute shaped portion of the outer wall 56 begins at a point (B) on the outer wall 56. Point (B) is radially aligned with the 73 degree point (b) on the circumference of the fan wheel 42. From this beginning point (B) on the volute shaped portion on the outer wall 56, the outer wall has points (C, D, E, F, G, H, I, J, K, L, M, N, O) that are radially spaced outwardly from and correspond to the respective circumferentially spaced points (c, d, e, f, g, h, i, j, k, l, m, n, o) on the circumference on the fan wheel 42. The volute shaped portion of the outer wall 56 has an ending point (O) that is radially aligned with the zero degree fan wheel beginning point (a) and the 360 degree fan wheel ending point (o).

The radial spacing between the points on the fan wheel circumference and their radially aligned corresponding points on the volute shaped portion of the outer wall 56 is determined by the equation: $Y=A+B\times^{c}$ In the above equation, the "x" value is the circumferential distance from point (b) on the fan wheel circumference at which the radial spacing between the fan wheel and the volute shaped portion of the outer wall is being calculated. This value is raised to the exponential power of (c). In the preferred embodiment of the invention, it has been determined empirically that the value (c) for points on the circumference of the fan wheel 42 from the fan wheel point (b) to the 270 degree fan wheel point (k) is an exponent in the range of 1.2 to 1.4. Preferably, the exponent is 1.3. For points on the circumference of the fan wheel from the 270 degree fan wheel point (k) to the fan wheel point corresponding to 360 degrees (o), the value of the exponent "c" is in the range of 1.5 to 2.1. Preferably, the exponent is 1.81.

In the above-referenced equation, the "A" factor is a minimum height factor for the blower housing 48. In the discussed embodiment, the minimum height factor "A" is 0.625 inches. The factor "B" in the above equation is a factor picked by the furnace designer to create as large of an exhaust opening as is practical, along with keeping the blower housing within size restrictions of the furnace enclosure 12'. The furnace designer designs the blower housing to allow a reasonable flow of air around the blower housing in the enclosure 12', while trying to hold down the exponential expansion of the blower housing outer wall 56 as much as possible, while at the same time obtaining the primary objective of a large air outlet opening 58. In the discussed embodiment, the factor "B" is 0.05645 for points on the circumference of the fan wheel 42 from the fan wheel point (b) to the 270 degree fan wheel point (k), and is 0.0128 for the points on the circumference of the fan wheel from the 270 degree point (k) to the 360 degree fan wheel point (o).

The exponentially increasing expansion angle of the volute-shaped portion of the outer wall 56 of the invention is based on a fan wheel 42 having a diameter dimension D of 10.625 inches. The size of the fan wheel influences the circumferential dimensions measured to the fan wheel points (b, c, d, e, f, g, h, i, j, k, l, m, n, o) which are raised to an exponential value to obtain the radial spacing between each of the respective points on the circumference of the fan wheel 42 and a radially aligned point on the volute outer wall 56. A blower housing having a volute outer wall 56 designed according to the earlier set forth equation provides an enlarged air outlet opening 58 without significantly increasing the overall dimensions of the blower housing 48 from that of prior art blower housings.

In alternate embodiments of the invention, the expansion angle of the volute outer wall 56 of the blower housing could increase exponentially with there being a single exponent value for the entire length of the volute-shaped outer wall 56. The expansion angle could increase exponentially with there being a single exponent value along a substantial portion of the volute-shaped outer wall portion 56, but not the entire portion. Additionally, the expansion angle could increase exponentially along separate segments of the volute-shaped outer wall portion, with there being different exponent values for the separate segments of the volute-shaped outer wall portion.

In the alternate embodiments of the invention, in the last 90° of the volute-shaped outer wall portion from point (K) to point (0) or from 270° to 360° on the volute-shaped portion of the outer wall, the expansion angle increasing at an exponential rate in a range of 1.5 to 2.1 enables the exhaust velocities of the air flow to be reduced, and creates a blower housing where a greater proportion of the air flow velocity head is converted to static pressure. This increases the efficiency of the blower housing because this velocity head energy would have been lost outside of the blower housing. This further increases the overall efficiency of the system. Too large of an expansion angle outside of the desired range would over-expand the blower housing and the area of air flow through the housing resulting in the air flow velocity head conversion to static pressure being too little and ineffective, failing to provide the effect needed.

Figure 5:
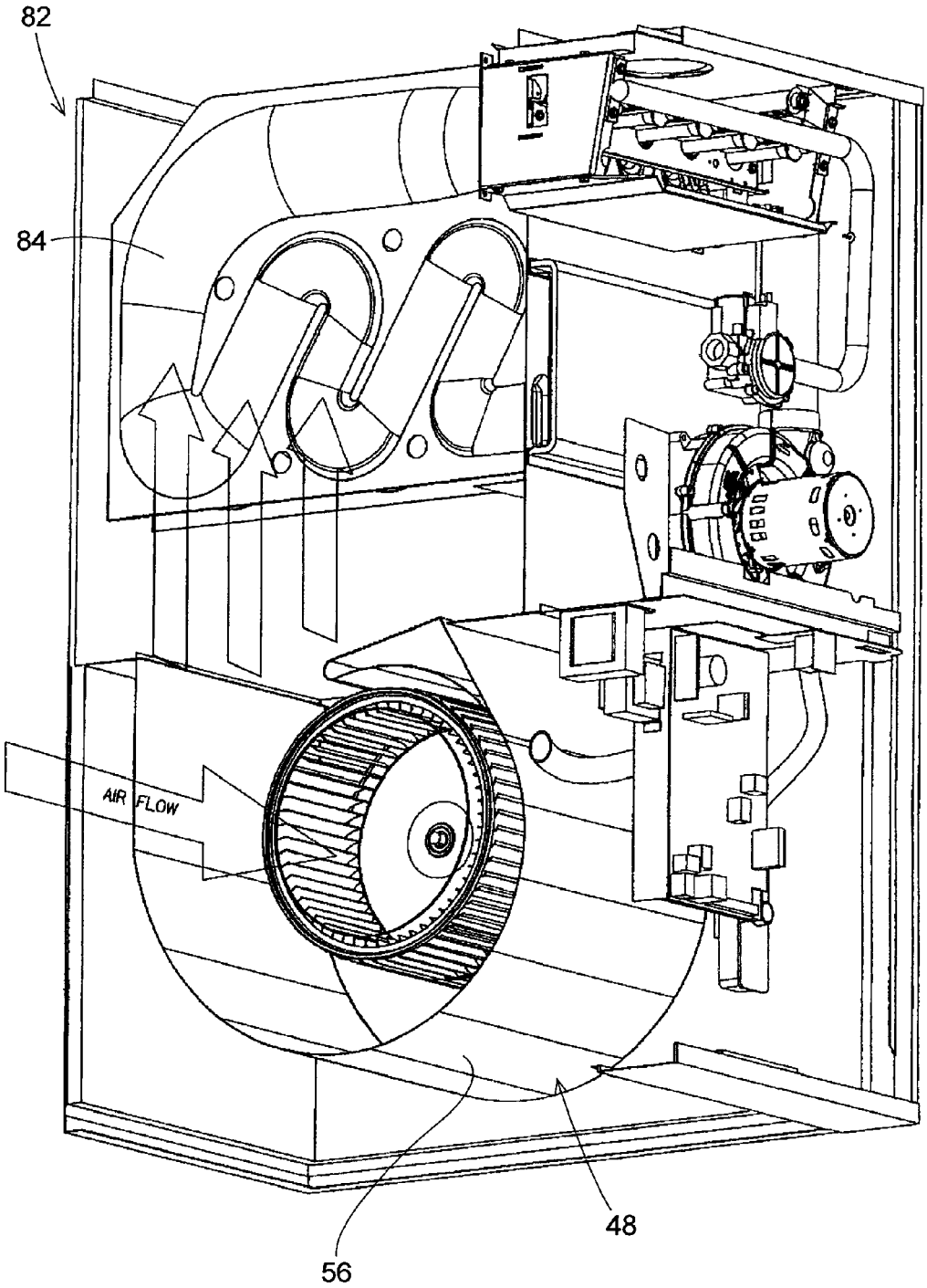
FIG. 5 is a partial view of a low profile 80+ furnace employing the blower housing of the invention.

In further embodiments of the invention, the blower housing of the invention could be employed in a low profile furnace, specifically an 80+ AFUE furnace, as well as in other types of furnaces and air handlers, and also in AC units. The alternate embodiment of a 80+ furnace is illustrated in FIG. 5. FIG. 5 illustrates the earlier described blower housing 48 of the invention employed in a low profile furnace 82, where the low profile furnace employs only a primary heat exchanger 84 and does not include a secondary heat exchanger as described earlier. Used in this environment, the blower housing 48 of the invention has similar or superior static efficiency to that of a regular profile blower. The use of the blower housing 48 in a low profile furnace allows savings in shipping costs and sheet metal cost. The particular two stage exponential growth of the volute outer wall 56 of the blower housing 48 provides similar performance and efficiency to the low profile 80+ furnace as that of a regular profile blower in a low profile size. In a similar manner to the 90+ furnace, in the 80+ furnace 82 where the primary heat exchanger 84 is located close to the blower housing air outlet opening, the enlarged air outlet opening of the blower housing of the invention directs air over a larger area of the heat exchanger 84 than blower housings of the prior art, and thereby creates energy savings.

In addition to being employed in a 90+ furnace and an 80+ furnace, the blower housing 48 of the invention may be employed in an air handler. Air handlers (abbreviated AHU) are employed in HVAC systems to move air through the systems. A typical air handler comprises a metal enclosure containing the blower housing of the invention. The air handler enclosure is typically communicated with one or more other enclosures containing heating and/or cooling coils and air filters. The air handler typically communicates with duct work that distributes the conditioned air through a building and returns the air to the air handler. Air handlers are also used to distribute air and return air directly to and from the area being served by the air handler without duct work. In the typical operation of an air handler, the rotation of the fan in the blower housing of the invention would pull air through the air filter and the heating and/or cooling coils to the blower housing and then distribute the conditioned air from the blower housing.

Although the above equation and the above described method of designing the volute-shaped outer wall of a blower housing based on the circumference dimensions of the fan wheel are described with reference to a particular fan wheel diameter dimension, there are particular blower housing and fan wheel dimension relationships that provide the synergistic effect of the increased efficiency of the blower housing of the invention. In the blower housing of the invention these synergistic results are achieved when the ratio of the minimum radial dimension of the air outlet opening (for example, the minimum dimension between the cutoff 72 at point (B) and the end of the straight portion 74 of the blower housing outer wall 48 opposite the point (O) shown in FIG. 4), and the fan wheel outer diameter dimension is at least 0.73. In addition, the ratio of the distance dimension between the fan wheel axis of rotation 44 and the second end of the blower housing outer wall volute-shaped portion at point (O), and the fan wheel outer diameter dimension is at least 0.91. Furthermore, in the preferred embodiment the radial distance between the fan wheel axis of rotation 44 and the volute-shaped portion of the blower housing outer wall increases as the volute-shaped portion extends from a first end of the volute-shaped portion around the fan wheel to the second end of the volute-shaped portion. Preferably the increase is exponential.

The dimensional relationships between the fan wheel and the blower housing outer wall of the invention set forth above result in the synergistic increase in the efficiency of the blower housing of the invention. This synergistic increase in efficiency is the result of three basic principles.

(1) The enlarged air outlet opening of the blower housing spreads out the flow of air exiting the blower housing over the furnace heat exchanger to a greater extent than prior art blower housings, and thereby reduces the pressure loss across the furnace. This lowers the required pressure that the blower must generate.

(2) The flow of air moving through the fan wheel is concentrated in the last half of the scroll configuration of the blower housing, and especially in the last 90° of the scroll configuration from point (K) to point (0) or from 270° to 360° on the volute-shaped length of the outer wall. Here the outer wall increases at an expansion angle of 10° or greater. This creates a higher air flow velocity through the forward-curved blades of the fan wheel, which increases static pressure gained on the fan wheel due to the coriollis effect. The higher air flow velocity also increases the velocity head off of the forwarded-curved blades of the fan wheel. This effect reduces the size of the fan wheel required in the blower housing for an equal powered blower, and increases the efficiency due to greater pressure being generated on the fan wheel blades.

(3) The blower housing volume aggressively becomes larger in the direction of fan wheel rotation in the blower housing of the invention, especially toward the air outlet opening. This enables the exhaust velocities of the air flow to be reduced, and creates a blower housing where a greater portion of the air flow velocity head is converted to static pressure. This increases the efficiency of the blower housing because this velocity head energy would have been lost outside of the blower housing. This further increases the overall efficiency of the system.

Figure 6:
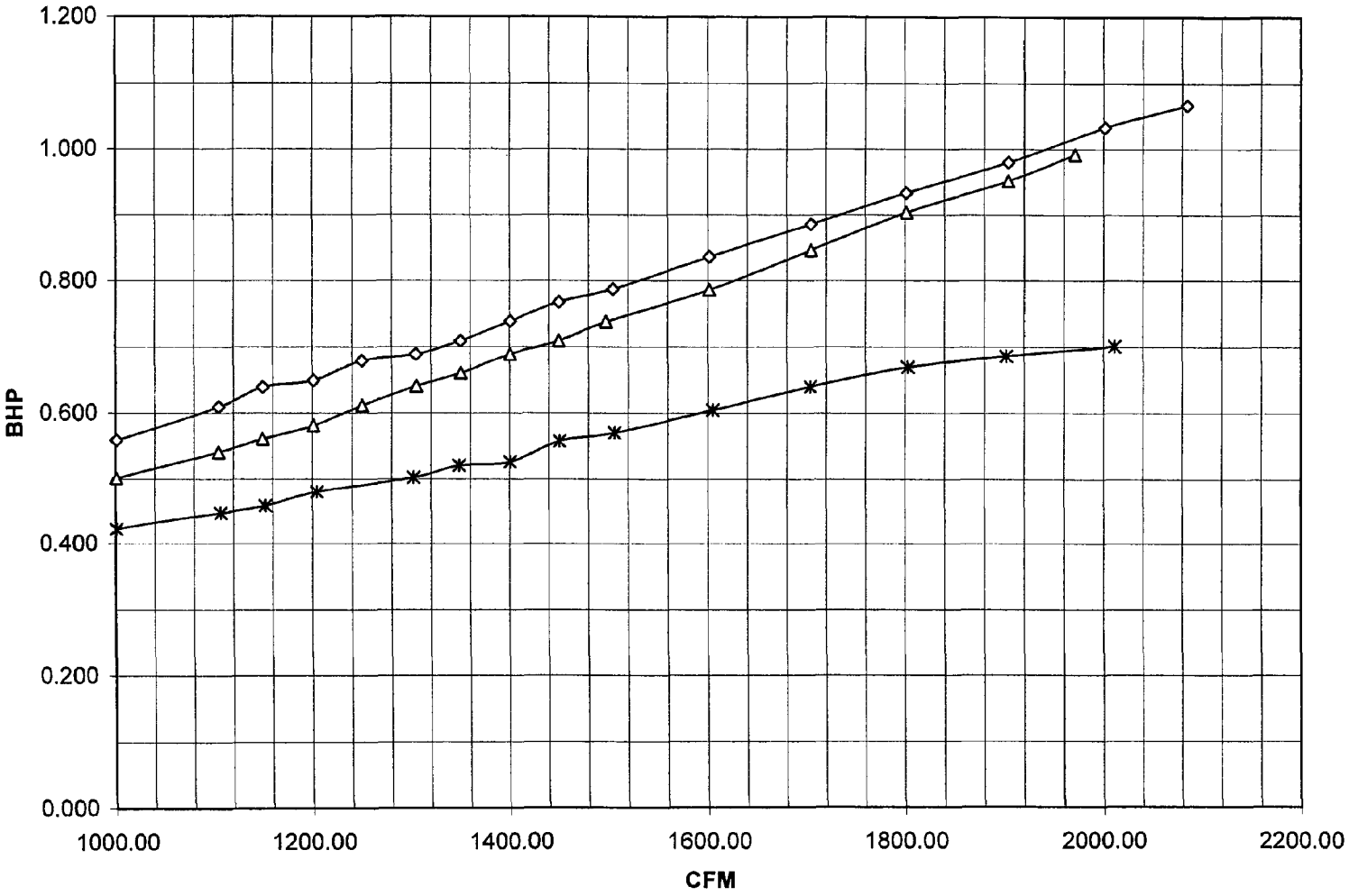
FIGS. 6 and 7 are graphs comparing the operation of blower housings of the invention with those of the prior art.

FIG. 6 is a graph illustrating the gain in efficiency of a high efficiency 90+ furnace employing the blower housing of the invention as compared to high efficiency 90+ furnaces of the prior art. In FIG. 6, the bottommost line on the graph represents the operation of the blower housing of the invention in a 90+ furnace. The other two graph lines represent the operation of 90+ furnaces of the prior art. From this graph it can be seen that the blower housing of the invention requires less horsepower of the fan wheel motor to move a volume of air through the furnace than the blower housings of the prior art.

Figure 7:
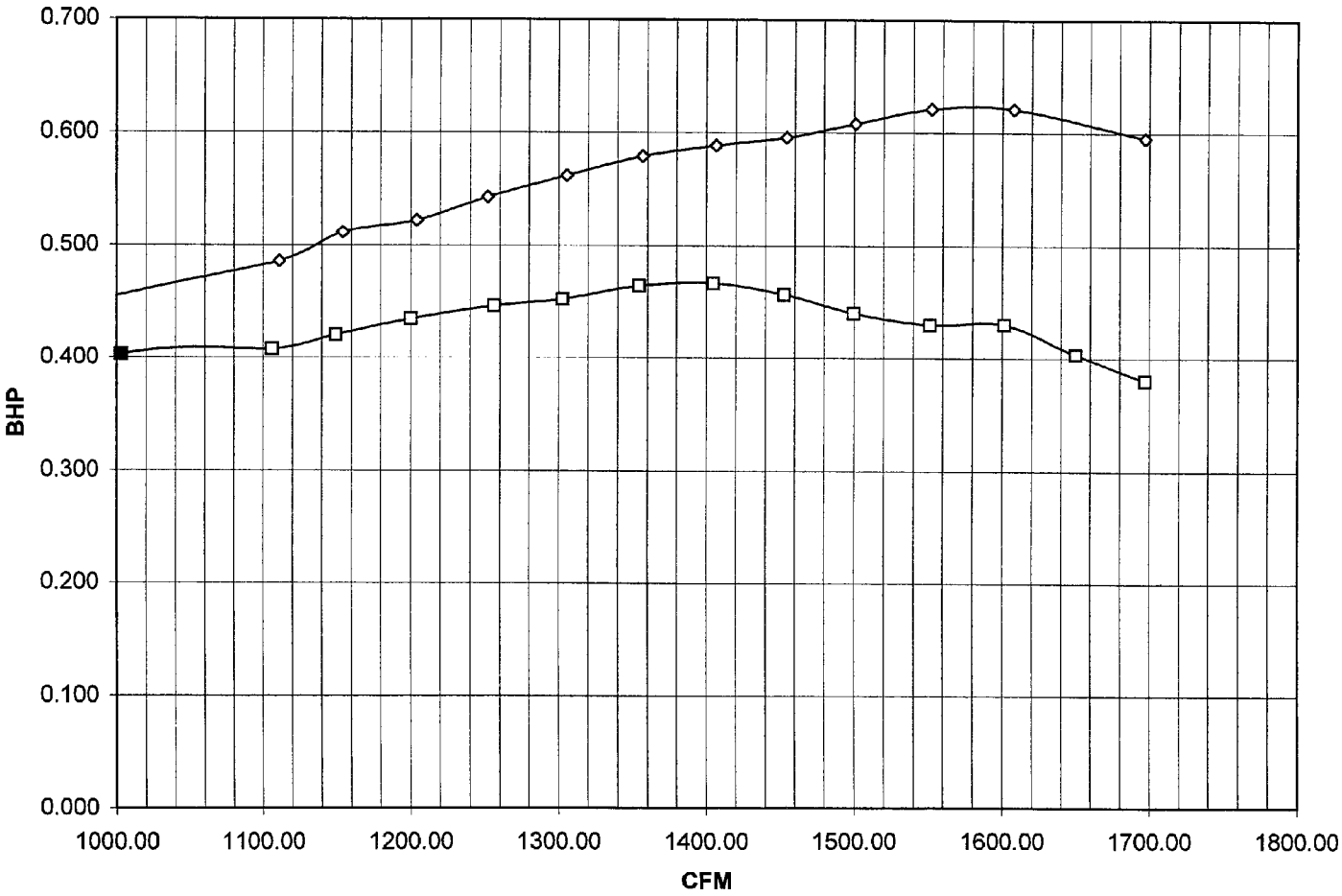
Figure 8:
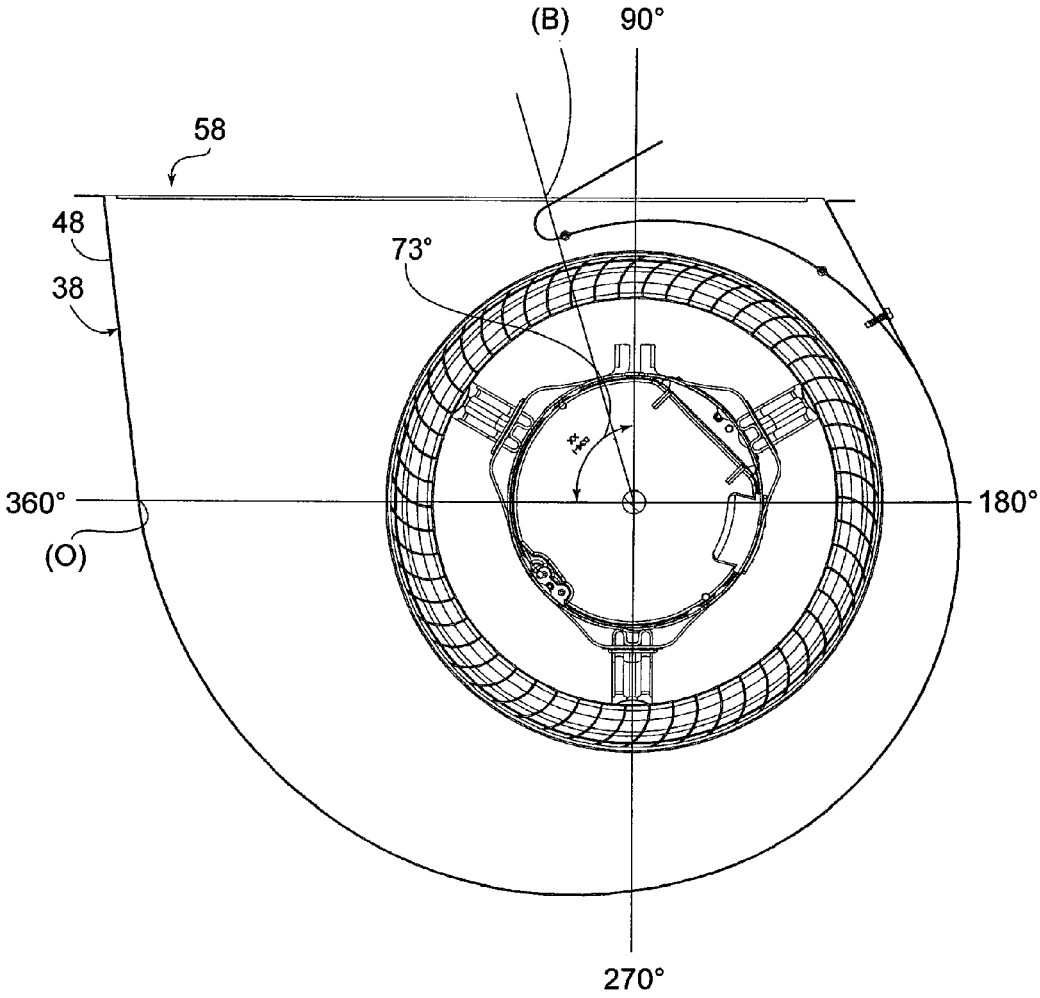
FIG. 8 is a view similar to FIG. 4 of a further configuration of the blower housing.

FIG. 7 is a graph similar to that of FIG. 6, but showing a comparison of the low profile 80+ blower housing of the invention compared with a low profile blower housing of the prior art. In FIG. 7, the lower line on the graph represents the operation of the low profile blower housing of the invention. In this graph it can also be seen that the low profile blower housing of the invention requires less horsepower to move a volume of air as compared to a blower housing of the prior art.

The above described embodiments of the invention were chosen in order to best explain the principles of the invention and its practical application to thereby enable others skilled in the art to best utilize the invention in various embodiments and with various modifications as are suited to the particular use contemplated.

As various modifications could be made in the constructions herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. An air handler comprising:

an enclosure having an interior volume and a distribution air outlet opening on the enclosure that is adapted for communication with an air distribution system;

a fan wheel in the enclosure interior volume, the fan wheel having an outer diameter dimension and a circumference dimension, the fan wheel having a center axis of rotation that defines mutually perpendicular axial and radial directions and the fan wheel being rotatable about the center axis of rotation in a rotation direction;

a blower housing in the enclosure interior volume, the blower housing containing the fan wheel and having an air outlet opening, the air outlet opening having a minimum radial dimension, a ratio of the minimum radial dimension and the fan wheel outer diameter dimension being at least 0.73, the blower housing having an outer wall with a volute-shaped portion that extends from a first end of the volute-shaped portion around the fan wheel in the rotation direction to the second end of the volute-shaped portion, and the volute-shaped portion of the blower housing outer wall having first and second sections as the volute-shaped portion extends in the rotation direction around the fan wheel, where an expansion angle of the second section of the volute-shaped portion increases at an exponential rate of 1.5 to 2.1.

2. The air handler of claim 1, further comprising:

the first section of the volute-shaped portion subtending an angle of at most 270° at the fan wheel center axis.

3. The air handler of claim 1, further comprising:

the first section of the volute-shaped portion subtending an angle of 270° at the fan wheel center axis and the second section of the volute-shaped portion subtending an angle of 90° at the fan wheel center axis.

4. The air handler of claim 1, further comprising:

an expansion angle of the first section of the volute-shaped portion increases at an exponential rate of 1.2 to 1.4.

5. The air handler of claim 1, further comprising:

the air handler being a furnace.

6. The air handler of claim 1, further comprising:

the volute-shaped portion of the outer wall consisting essentially of the first section and the second section of the volute-shaped portion.

7. An air handler comprising:

an enclosure having an interior volume and a distribution air outlet opening on the enclosure that is adapted for communication with an air distribution system;

a fan wheel in the enclosure interior volume, the fan wheel having an outer diameter dimension and a circumference dimension, the fan wheel having a center axis of rotation that defines mutually perpendicular axial and radial directions and the fan wheel being rotatable about the center axis of rotation in a rotation direction;

a blower housing in the enclosure interior volume, the blower housing containing the fan wheel and having an air outlet opening, the air outlet opening having a minimum radial dimension, a ratio of the minimum radial dimension and the fan wheel outer diameter dimension being at least 0.73, the blower housing having an outer wall with a volute-shaped portion that extends from a first end of the volute-shaped portion around the fan wheel in the rotation direction to the second end of the volute-shaped portion, the first end of the volute-shaped portion being spaced radially a first distance dimension from the fan wheel axis of rotation and the second end of the volute-shaped portion being spaced radially a second distance dimension from the fan wheel axis of rotation that is larger than the first distance, and the volute-shaped portion of the blower housing outer wall having first and second sections with different generally increasing expansion angles as the volute-shaped portion extends in the rotation direction around the fan wheel, where the expansion angle of the second section of the volute-shaped portion increases at an exponential rate of 1.5 to 2.1.

8. The air handler of claim 7, further comprising:

the first section of the volute-shaped portion extends over at most 270° of the fan wheel circumference dimension.

9. The air handler of claim 7, further comprising:

the first section of the volute-shaped portion extends over 270° of the fan wheel circumference dimension and the second section of the volute-shaped portion extends over 90° of the fan wheel circumference dimension.

10. The air handler of claim 7, further comprising:

the blower housing outer wall having a length that includes the volute-shaped portion and extends from a first end of the outer wall around the fan wheel in the rotation direction to the second end of the outer wall, the first end of the outer wall being spaced radially a first distance dimension from the fan wheel axis of rotation and the second end of the outer wall being spaced radially a second distance dimension from the fan wheel axis of rotation that is larger than the first distance; and, a ratio of the second distance dimension and the fan wheel outer diameter being at least 0.91.

11. The air handler of claim 7, further comprising:

the air handler being a furnace.

12. The air handler of claim 7, further comprising:

the volute-shaped portion of the outer wall consisting essentially of the first section and the second section of the volute-shaped portion.

13. An air handler comprising:

an enclosure having an interior volume enclosed in opposite front and rear walls of the enclosure each having a width dimension, opposite left and right side walls of the enclosure each having a length dimension, and an opposite top and bottom of the enclosure, and a distribution air outlet opening on the enclosure that is adapted for communication of a distribution air stream from the enclosure to an exterior environment of the enclosure;

a fan wheel in the enclosure interior volume, the fan wheel having an outer diameter dimension, an axis of rotation that defines mutually perpendicular axial and radial directions, and the fan wheel being rotatable in a rotation direction around the axis of rotation;

a blower housing in the enclosure interior volume, the blower housing having an interior volume containing the fan wheel and an air flow outlet opening, the air outlet opening having a minimum radial dimension, a ratio of the minimum radial dimension and the fan wheel outer diameter dimension being at least 0.73, the blower housing having first and second side walls on axially opposite ends of the fan wheel, and the blower housing having an outer wall having a width dimension extending between the first and second side walls, the outer wall having a volute-shaped portion that spirals away from the fan wheel axis of rotation as it extends in the rotation direction from a first end of the volute-shaped portion at one side of the air flow outlet opening around the blower housing interior volume to a second end of the volute-shaped portion at an opposite side of the air flow outlet opening from the first end, the volute-shaped portion of the blower housing outer wall having first and second sections, the second section being spaced from the first end of the volute-shaped portion by the first section, and the second section of the volute-shaped portion having an expansion angle that increases at an exponential rate in a range of 1.5 to 2.1.

14. The air handler of claim 13, further comprising:

the first section of the volute-shaped portion subtending an angle of at most 270° at the fan wheel center axis.

15. The air handler of claim 13, further comprising:

the first section of the volute-shaped portion subtending an angle of 270° at the fan wheel center axis and the second section of the volute-shaped portion subtending an angle of 90° at the fan wheel center axis.

16. The air handler of claim 13, further comprising:

an expansion angle of the first section of the volute-shaped portion increases at an exponential rate of 1.2 to 1.4.

17. The air handler of claim 13, further comprising:

the air handler being a furnace.

18. The air handler of claim 13, further comprising:

the volute-shaped portion of the outer wall consisting essentially of the first section and the second section of the volute-shaped portion.

19. The air handler of claim 13, further comprising:

the outer wall having a straight portion that extends from the second end of the volute-shaped portion to the air flow outlet opening of the blower housing.

* * * * *